US008690026B2

(12) United States Patent
Richards et al.

(10) Patent No.: US 8,690,026 B2
(45) Date of Patent: Apr. 8, 2014

(54) FLUID DISPENSING ASSEMBLY

(75) Inventors: James L. Richards, Dassel, MN (US); Loren L. Brelje, Glencoe, MN (US); Michael Maher, Hutchinson, MN (US)

(73) Assignee: David S. Smith America, Inc., Lester Prairie, MN (US)

( * ) Notice: Subject to any disclaimer, the term of this patent is extended or adjusted under 35 U.S.C. 154(b) by 20 days.

(21) Appl. No.: 13/280,985

(22) Filed: Oct. 25, 2011

(65) Prior Publication Data

US 2013/0098947 A1 Apr. 25, 2013

(51) Int. Cl.
*B67D 3/00* (2006.01)

(52) U.S. Cl.
USPC ..... 222/484; 222/188

(58) Field of Classification Search
USPC ..... 222/482–484, 470–473, 478, 475, 222/475.1, 468, 604, 605, 505–509, 566, 222/567, 153.01, 188
See application file for complete search history.

(56) References Cited

U.S. PATENT DOCUMENTS

| | | | | |
|---|---|---|---|---|
| 1,092,101 | A | 3/1914 | Hansen | |
| 1,266,396 | A * | 5/1918 | Brown | 222/473 |
| 2,197,352 | A | 4/1940 | Terkel | |
| 2,842,291 | A | 7/1958 | Duval et al. | |
| 3,059,816 | A | 10/1962 | Goldstein | |
| 3,642,179 | A | 2/1972 | Micallef | |
| 3,655,102 | A | 4/1972 | Moran | |
| 3,726,442 | A | 4/1973 | Davidson et al. | |
| 3,739,938 | A | 6/1973 | Paz | |
| 3,913,611 | A | 10/1975 | St. John | |
| 3,972,443 | A | 8/1976 | Albert | |
| 4,133,446 | A | 1/1979 | Albert | |
| 4,471,807 | A * | 9/1984 | Lucking et al. | 137/614.19 |
| 4,487,342 | A | 12/1984 | Shy | |
| 4,687,122 | A | 8/1987 | Bothun et al. | |
| 4,782,985 | A | 11/1988 | Kinsley | |
| 4,815,616 | A | 3/1989 | Silvenis | |
| 4,844,290 | A | 7/1989 | McCurdy et al. | |
| 4,893,651 | A | 1/1990 | Hermann et al. | |
| 4,930,689 | A | 6/1990 | Stumpf | |
| 4,942,976 | A * | 7/1990 | Spencer | 222/153.14 |
| 5,037,015 | A | 8/1991 | Collins | |
| 5,115,949 | A | 5/1992 | Rosenthal | |
| 5,485,938 | A | 1/1996 | Boersma | |
| 5,947,343 | A | 9/1999 | Horstmann | |

(Continued)

FOREIGN PATENT DOCUMENTS

| | | |
|---|---|---|
| EP | 1566122 A1 | 8/2005 |
| NL | 1003708 | 5/1998 |

OTHER PUBLICATIONS

Search Report and Written Opinion issued on Jun. 28, 2012 for PCT Application No. PCT/US2011/057844.

(Continued)

*Primary Examiner* — Lien Ngo
(74) *Attorney, Agent, or Firm* — Vidas, Arrett & Steinkraus, P.A.

(57) ABSTRACT

A fluid dispensing valve assembly comprises a housing, a lever, a resilient member, and a seal. The housing defines a fluid dispensing port and a vent opening. The fluid dispensing valve can be operated with a single hand to dispense liquid from a container. Further, upon release of the lever, the fluid dispensing valve automatically returns to a sealed configuration, thereby preventing fluid from leaking out of the container.

17 Claims, 14 Drawing Sheets

(56) References Cited

U.S. PATENT DOCUMENTS

| | | | | |
|---|---|---|---|---|
| 6,364,178 | B1 | 4/2002 | Paczonay | |
| 6,401,752 | B1 | 6/2002 | Blackbourn et al. | |
| 6,427,880 | B1 | 8/2002 | Hirose et al. | |
| 6,446,845 | B1 | 9/2002 | Steiger | |
| 6,763,964 | B1 | 7/2004 | Hurlbut et al. | |
| 7,195,137 | B2 | 3/2007 | Belcastro | |
| 7,513,395 | B2 | 4/2009 | Labinski et al. | |
| 7,735,698 | B2 * | 6/2010 | Lin | 222/472 |
| 8,113,239 | B2 | 2/2012 | Richards et al. | |
| D676,320 | S | 2/2013 | Richards et al. | |
| 8,365,962 | B2 | 2/2013 | Canfield | |
| 2003/0034364 | A1 | 2/2003 | Mugge | |
| 2009/0057349 | A1 | 3/2009 | Lin | |
| 2009/0090745 | A1 | 4/2009 | Forbis | |
| 2012/0018459 | A1 * | 1/2012 | Richards et al. | 222/484 |
| 2013/0270305 | A1 | 10/2013 | Richards | |

OTHER PUBLICATIONS

U.S. Appl. No. 12/839,860, filed Jul. 20, 2010, Dispenser Assembly.

U.S. Appl. No. 29/404,767, filed Oct. 25, 2011, Fluid Dispenser.

Thermoplastic Copolyester Elastomer data sheet, document created date Jul. 16, 2010.

Non-Final Office Action for U.S. Appl. No. 13/914,082, mailed on Aug. 26, 2013.

* cited by examiner

FLUID DISPENSING ASSEMBLY

CROSS-REFERENCE TO RELATED APPLICATIONS

This Utility Application is being filed concurrently with US Design Application titled "Fluid Dispenser"; having application Ser. No. 29/404,767; and inventors James Richards, Loren Brelje, and Michael Maher; the contents of which are herein incorporated by reference.

STATEMENT REGARDING FEDERALLY SPONSORED RESEARCH

Not Applicable.

FIELD OF THE INVENTION

Embodiments of the present invention generally relate to devices and methods for dispensing fluids, and more particularly, to a self-venting fluid dispensing assembly and method of production.

BACKGROUND

Various types of push-button actuated dispensing valves for dispensing liquids from a relatively large capacity container are known in the art. Where the dispensing valve or tap is used with a flexible wall container (e.g., collapsible wall), it is unnecessary for the container to be vented because no pressure differential is created upon emptying of the container through the tap.

In contrast, with a rigid container, a vent, or other system, must be provided for equalizing the pressure differential created as the contents of the rigid container are dispensed.

There remains a need for a low cost, easy to assemble, reliable, and self-venting dispensing valve that can be actuated by an operator with a single hand. Further, there remains a need for such a dispensing valve that can be used with liquids of varying viscosity, having an automatic shut-off function to prevent inadvertent dispensing.

All US patents and applications and all other published documents mentioned anywhere in this application are incorporated herein by reference in their entirety.

Without limiting the scope of the invention a brief summary of some of the claimed embodiments of the invention is set forth below. Additional details of the summarized embodiments of the invention and/or additional embodiments of the invention may be found in the Detailed Description of the Invention, below.

A brief abstract of the technical disclosure in the specification is provided as well only for the purposes of complying with 37 C.F.R. 1.72. The abstract is not intended to be used for interpreting the scope of the claims.

SUMMARY OF THE INVENTION

In some embodiments, a fluid dispensing valve assembly comprises a housing defining a fluid dispensing port and a vent opening. The valve assembly further comprises a lever extending from the housing over at least a portion of the fluid dispensing port, an elastically deformable resilient member and a seal. In some embodiments, the seal comprises a base portion, a stem extending from the base portion, and a sealing arm extending from the base portion. At least a portion of the seal extends through the fluid dispensing port. Further, in some embodiments, at least a portion of the elastically deformable resilient member and at least a portion of the stem contact the lever.

In some embodiments, the lever is hingedly attached to the housing.

In some embodiments, the valve assembly further has an open configuration and a sealed configuration. The resilient member further comprises a sealing tab. In some embodiments, at least a portion of the sealing tab is configured to cover the vent opening when the assembly is in the sealed configuration.

In some embodiments, the resilient member comprises a dome-shaped portion and a retaining catch.

In some embodiments, the housing defines a hole through which at least a portion of the resilient member extends.

In some embodiments, the housing comprises a channel and the seal comprises a guide, the guide slidably disposed within the channel.

In some embodiments, the housing comprises two channels that are arranged in a facing, opposed relationship, one on either side of the fluid dispensing port.

In some embodiments, the seal comprises two guides, each guide slidably disposed within one of the two channels.

In some embodiments, the portion of the stem that contacts the lever is configured to move in an arc and the guides are configured to move linearly.

In some embodiments, the housing further comprises a pair of flared grip members.

In some embodiments, the lever is connected to the seal.

In some embodiments, a fluid dispensing valve assembly has a sealed configuration and a fluid flow configuration. The valve assembly comprises a housing defining a fluid dispensing port and a vent opening. Further, the valve assembly comprises a lever extending from the housing over at least a portion of the fluid dispensing port, an elastically deformable resilient member, and a seal. The elastically deformable resilient member comprises a sealing tab and a dome portion. The sealing tab is configured to cover the vent opening when the valve assembly is in the sealed configuration. In some embodiments, the seal is disposed within the fluid dispensing port and at least a portion of the seal contacts the sealing tab when the valve assembly is in the sealed configuration. In some embodiments, at least a portion of the elastically deformable resilient member and at least a portion of the seal contact the lever.

In some embodiments, the seal comprises a base portion, a stem extending from the base portion, and a sealing arm extending from the base portion.

In some embodiments, at least a portion of the sealing arm contacts the sealing tab when the valve assembly is in the sealed configuration.

In some embodiments, the lever is connected to the seal.

In some embodiments, the housing comprises at least one channel and the seal comprises at least one guide. The guide is slidably disposed within the channel.

In some embodiments, the resilient member comprises a retaining catch.

In some embodiments, the housing comprises a cork seal and a retaining ring opposed to the cork seal.

In some embodiments, the lever comprises an actuator and the actuator engages the dome portion of the resilient member.

In some embodiments, a fluid dispensing valve assembly has a sealed configuration and a fluid flow configuration. In some embodiments, the fluid dispensing valve assembly consists of three components. A first component comprises a housing and a lever, a second component comprises a resilient member, and a third component comprises a seal. In some embodiments, at least a portion of the lever is moveable with respect to the housing. The housing defines a fluid dispensing port. In some embodiments, at least a portion of the lever contacts the resilient member and at least a portion of the seal contacts at least a portion of the lever. The seal is moveable within the fluid dispensing port to selectively dispense fluid.

In some embodiments, the housing defines a vent opening and the resilient member comprises a sealing tab. In some embodiments, the sealing tab covers the vent opening when the valve assembly is in the sealed configuration.

DETAILED DESCRIPTION

Figure 1A:
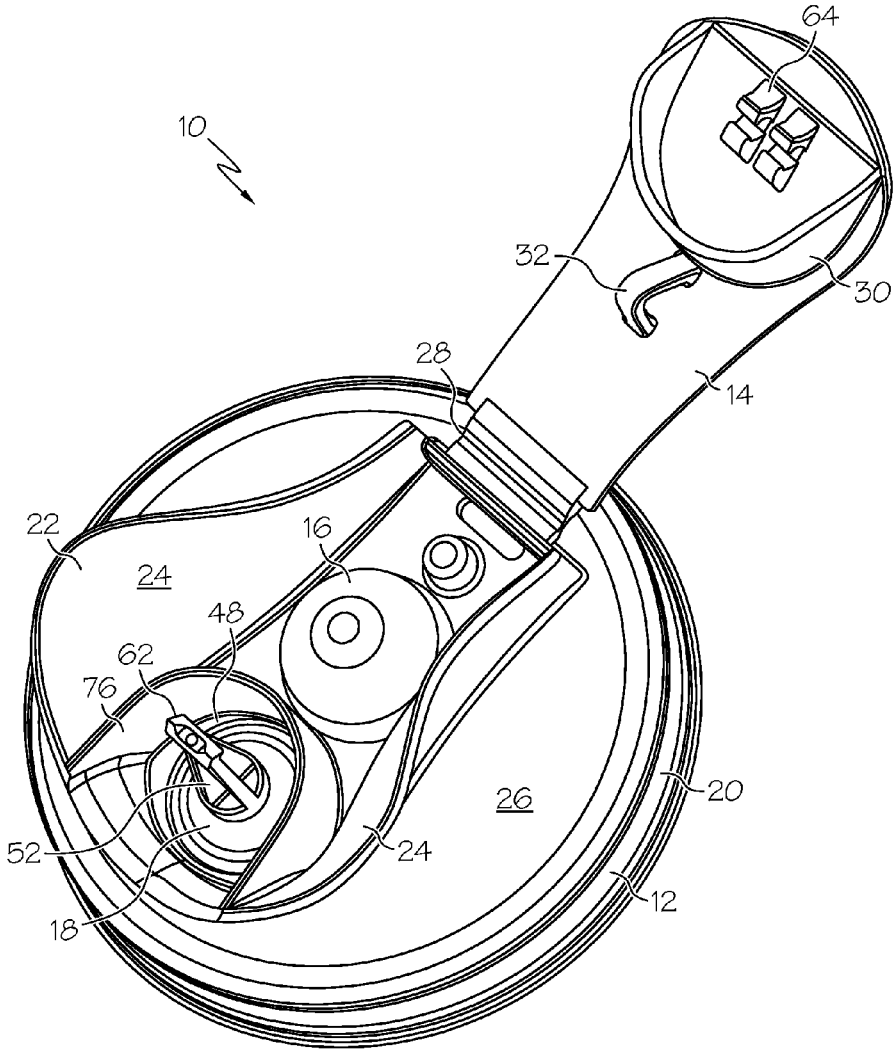
FIG. 1A shows a front perspective view of an embodiment of the valve assembly 10.

While this invention may be embodied in many different forms, there are described herein specific embodiments. This description is an exemplification of the principles of the invention and is not intended to limit it to the particular embodiments illustrated.

For the purposes of this disclosure, like reference numerals in the figures shall refer to like features unless otherwise indicated.

Figure 1B:
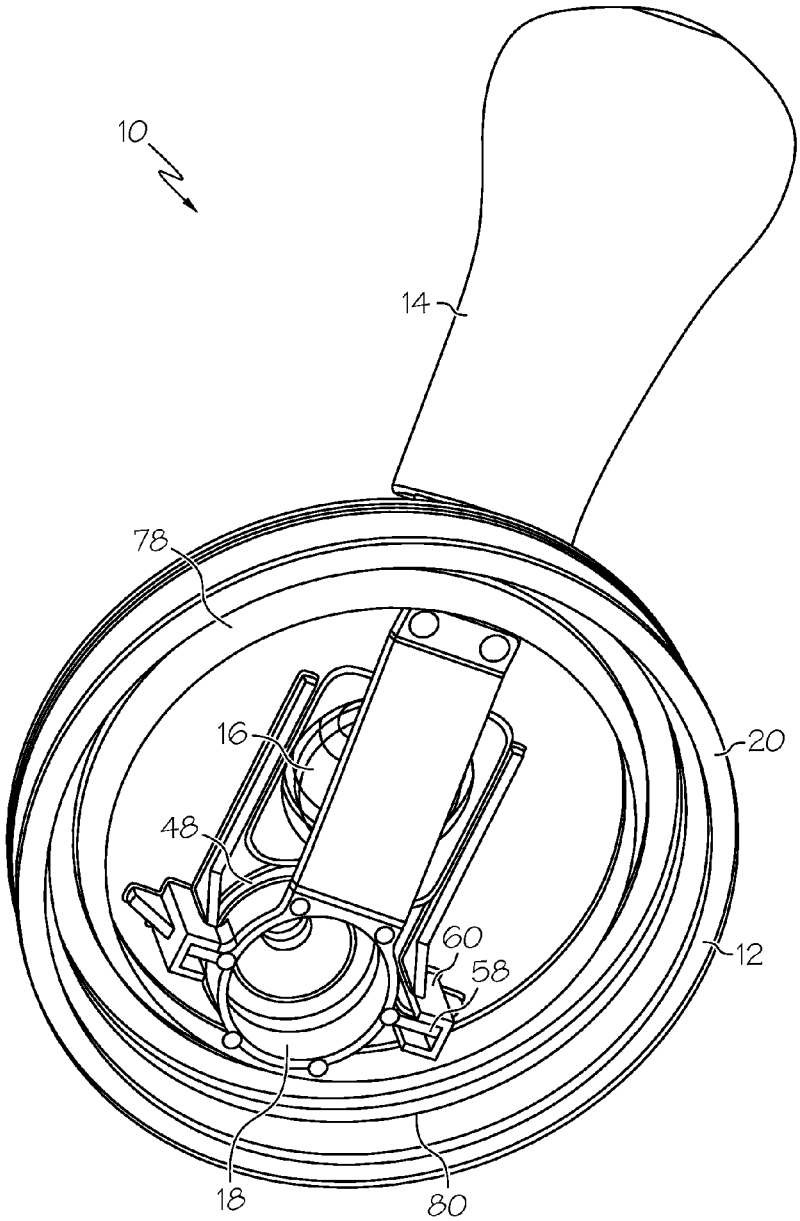
FIG. 1B shows a back perspective view of the valve assembly of FIG. 1A.
Figure 1C:
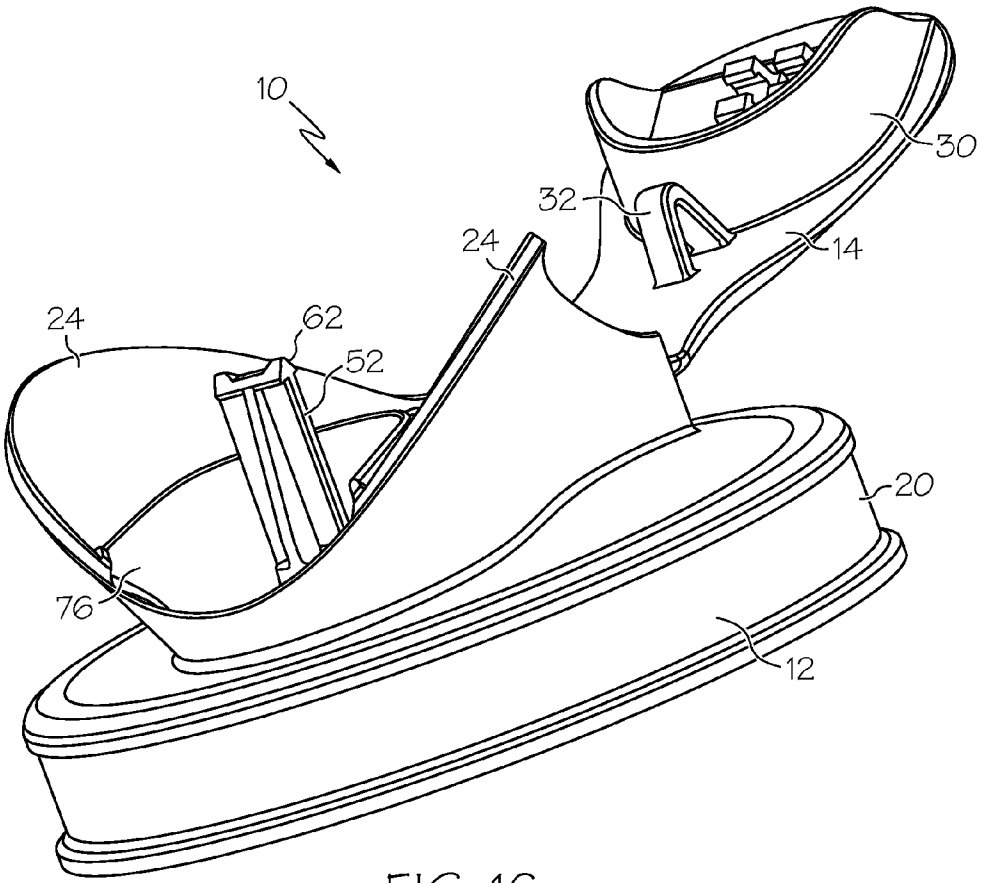
FIG. 1C shows a side perspective view of the valve assembly of FIG. 1A.

Shown in FIGS. 1A-1C is an embodiment of a fluid dispensing valve assembly 10, which may also be referred to herein as "valve assembly" or "assembly." In some embodiments, the valve assembly 10 comprises a housing 12, a lever 14, a resilient member 16, and a seal 18. As shown in FIGS. 1A-1C, the housing 12 is in an "as-molded" configuration. In the as-molded configuration, the lever 14 has not been yet been folded about hinge 28 (discussed in greater detail below).

In some embodiments, the housing 12 comprises a cylindrical body 20 and a grip 22. The cylindrical body 20 is formed to attach to an outlet port on a fluid container, which may contain, for example, a consumable liquid such as water, juice, dairy products, edible oils, and sports drinks. Of course, other liquids of various viscosities are also contemplated.

In some embodiments, the grip 22 comprises a pair of flared grip members 24. The flared grip members 24 are contoured to permit the operator to operate the valve assembly 10 with a single hand, for example by placing an index finger and middle finger between a respective grip member 24 and the face 26 of the cylindrical body 20, as will be apparent from FIG. 1C.

With further reference to FIGS. 1A-1C, in some embodiments, the lever 14 is hingedly connected to the housing 12 via hinge 28. In some embodiments, the lever 14 and the housing 12 are formed in the same molding process, and the hinge 28 comprises a section of reduced material thickness connecting the lever 14 to the housing 12.

In some embodiments, the lever 14 further comprises a lip 30 and an actuator 32. The actuator 32 contacts the resilient member 16 when the assembly 10 is in the "as-used" configuration, shown for example in FIGS. 4A and 4B.

Figure 2A:
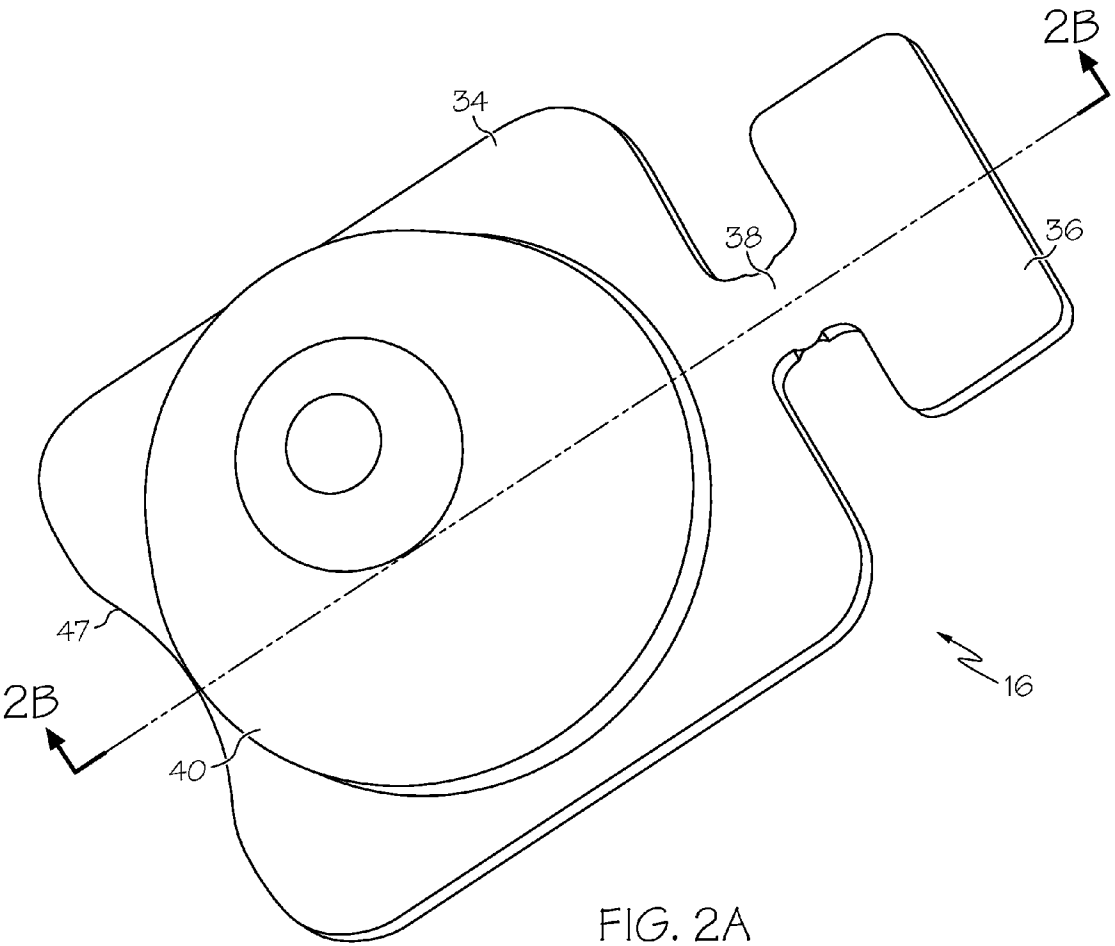
FIG. 2A shows a front perspective view of an embodiment of the resilient member 16.
Figure 2B:
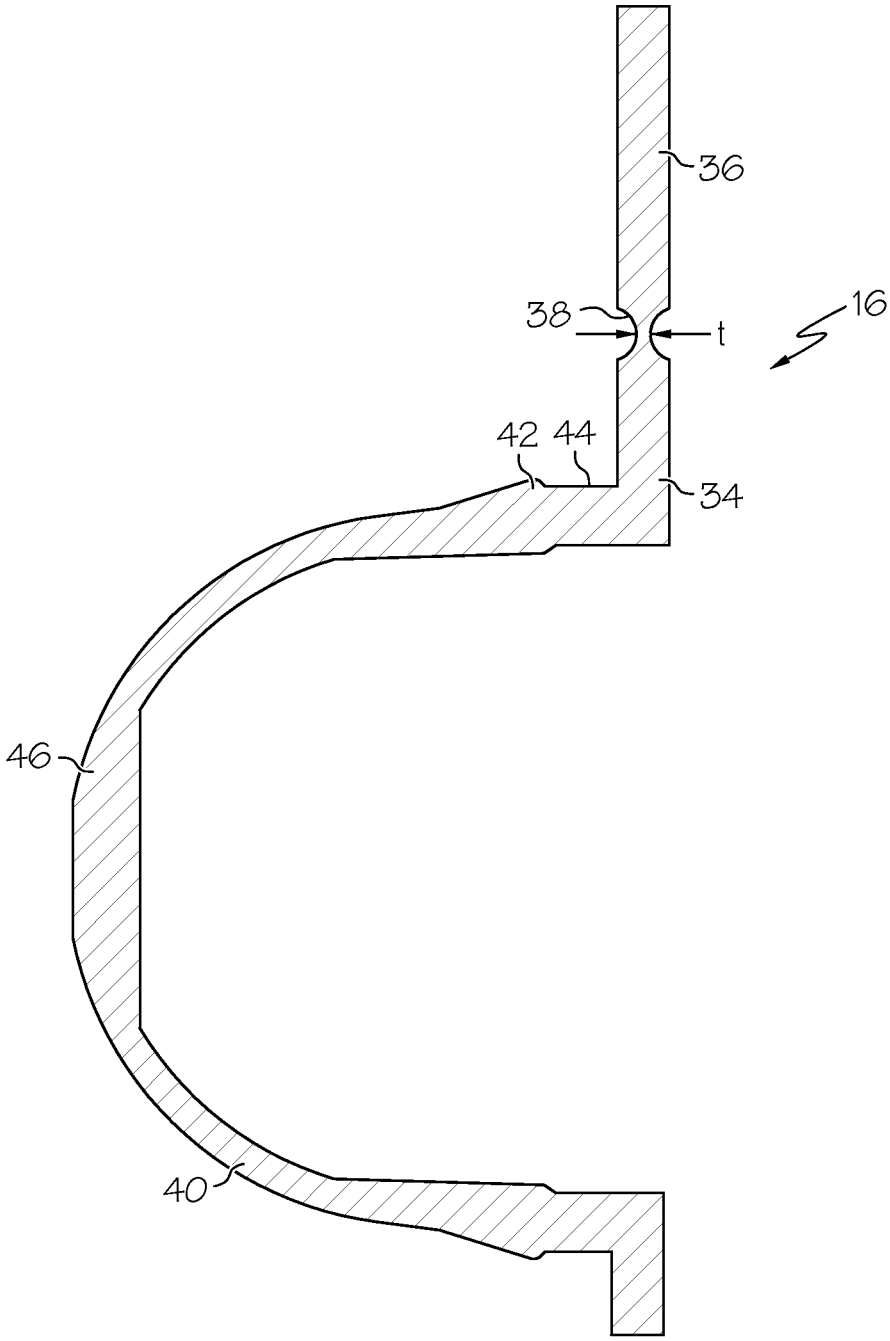
FIG. 2B shows a cross-sectional view of the resilient member of FIG. 2A.
Figure 2C:
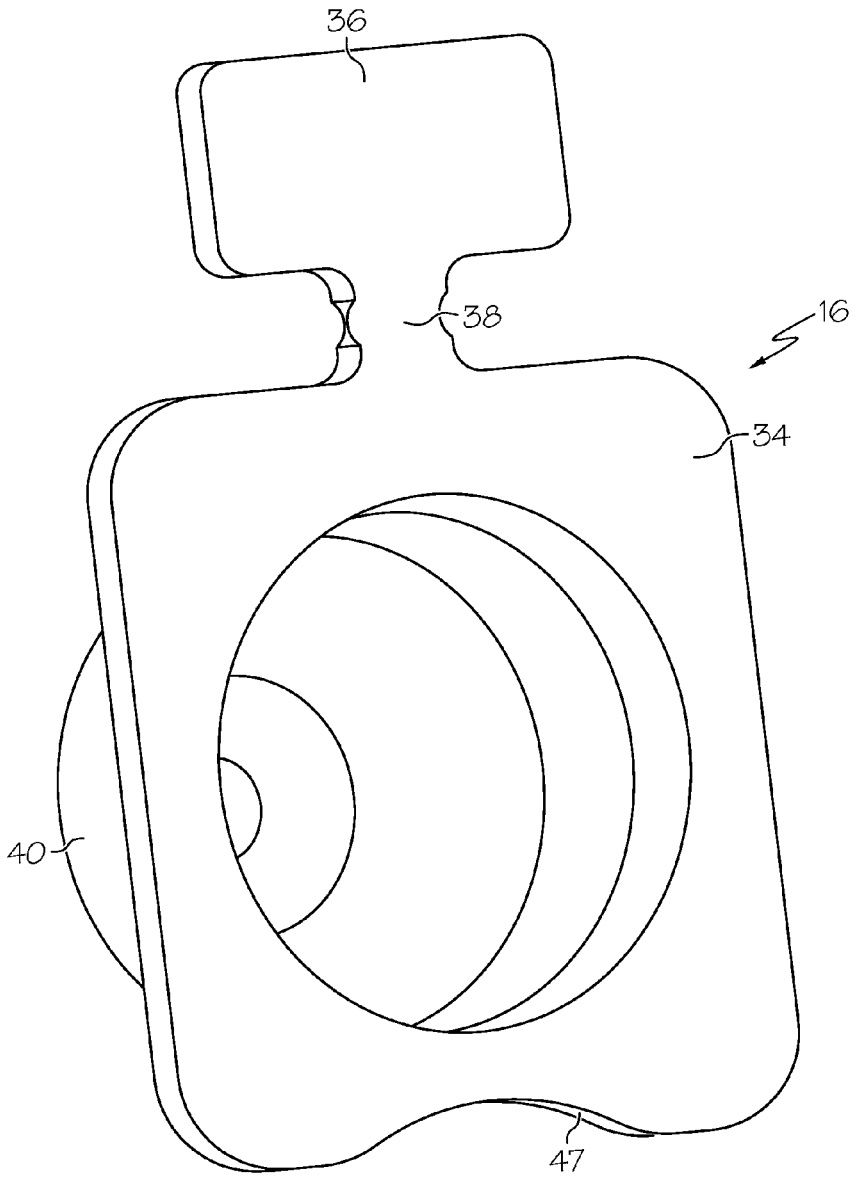
FIG. 2C shows a back perspective view of the resilient member of FIG. 2A.

Turning to FIGS. 2A-2C, an embodiment of the resilient member 16 is shown therein. The resilient member 16 comprises a body portion 34 and a sealing tab 36. The sealing tab 36 is desirably connected to the body portion 34 via tab hinge 38. In this way, in some embodiments, the sealing tab 36 is hingedly attached to the body portion 34. Further, the resilient member 16 may be formed in a single molding process, for example by injection molding. Other suitable manufacturing techniques may also be used. In some embodiments, the resilient member 16 is made from a thermoplastic elastomer (TPE), for example a copolyester elastomer such as Arnitel® EM 400. In some embodiments, the resilient member 16 has a durometer of between 25 and 36 shore D, inclusive. In some embodiments, the resilient member 16 has a durometer of 27 shore D and in some embodiments has a durometer of 35 shore D. Additionally, in some embodiments, the resilient member 16 is formed from Arnitel® EL250. The resilient members 16 can also be made from Dynaflex™ TPE or any other suitable material.

As shown in FIG. 2B, in some embodiments, the tab hinge 38 is a region of decreased material thickness, t, spanning between the body portion 34 and the sealing tab 36. The material thickness, t, is measured, as shown in FIG. 2B, in cross-section perpendicular to the wall.

Figure 4A:
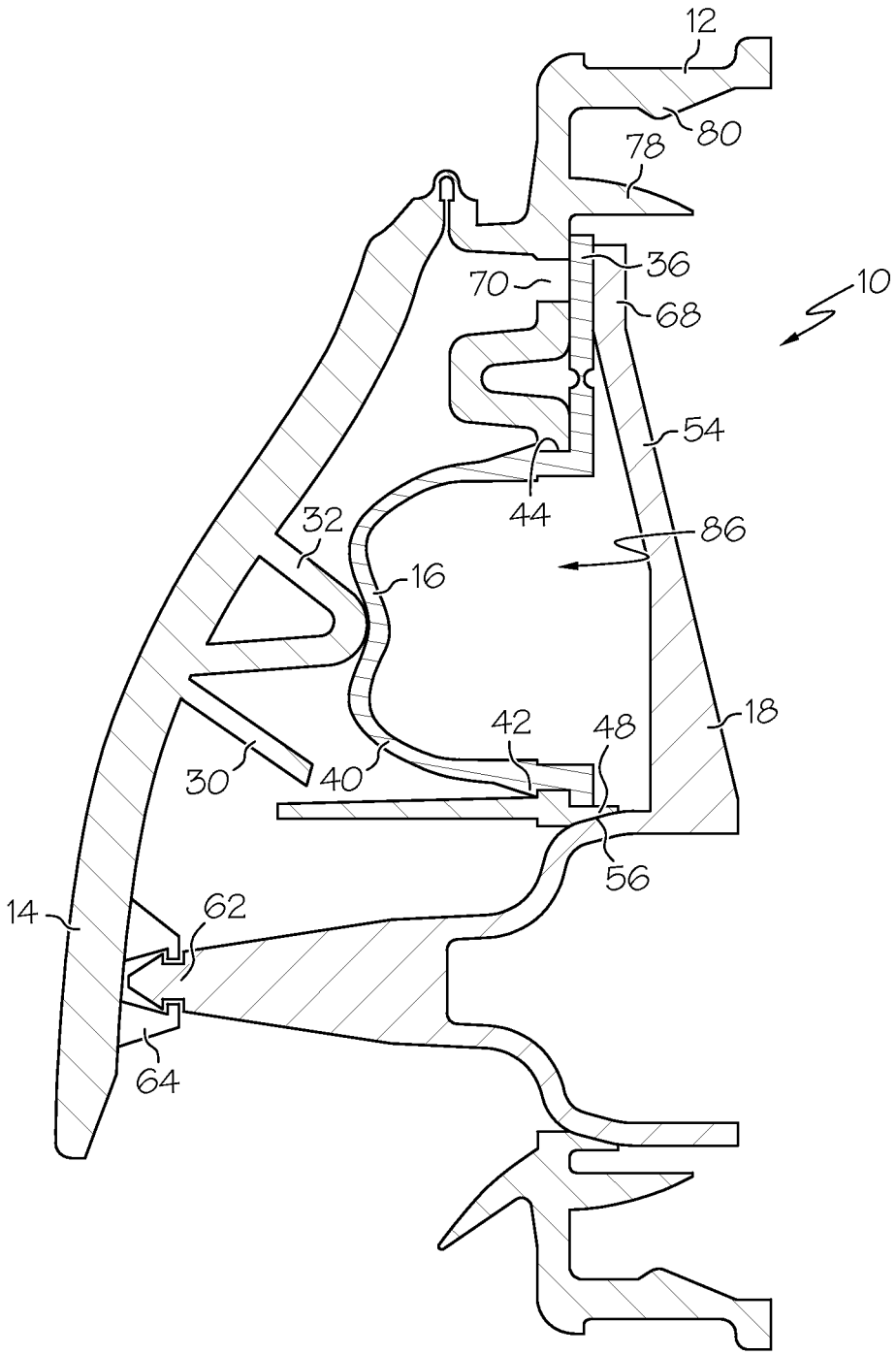
FIG. 4A shows a cross-sectional view of an embodiment of the valve assembly 10 in the sealed configuration.
Figure 4B:
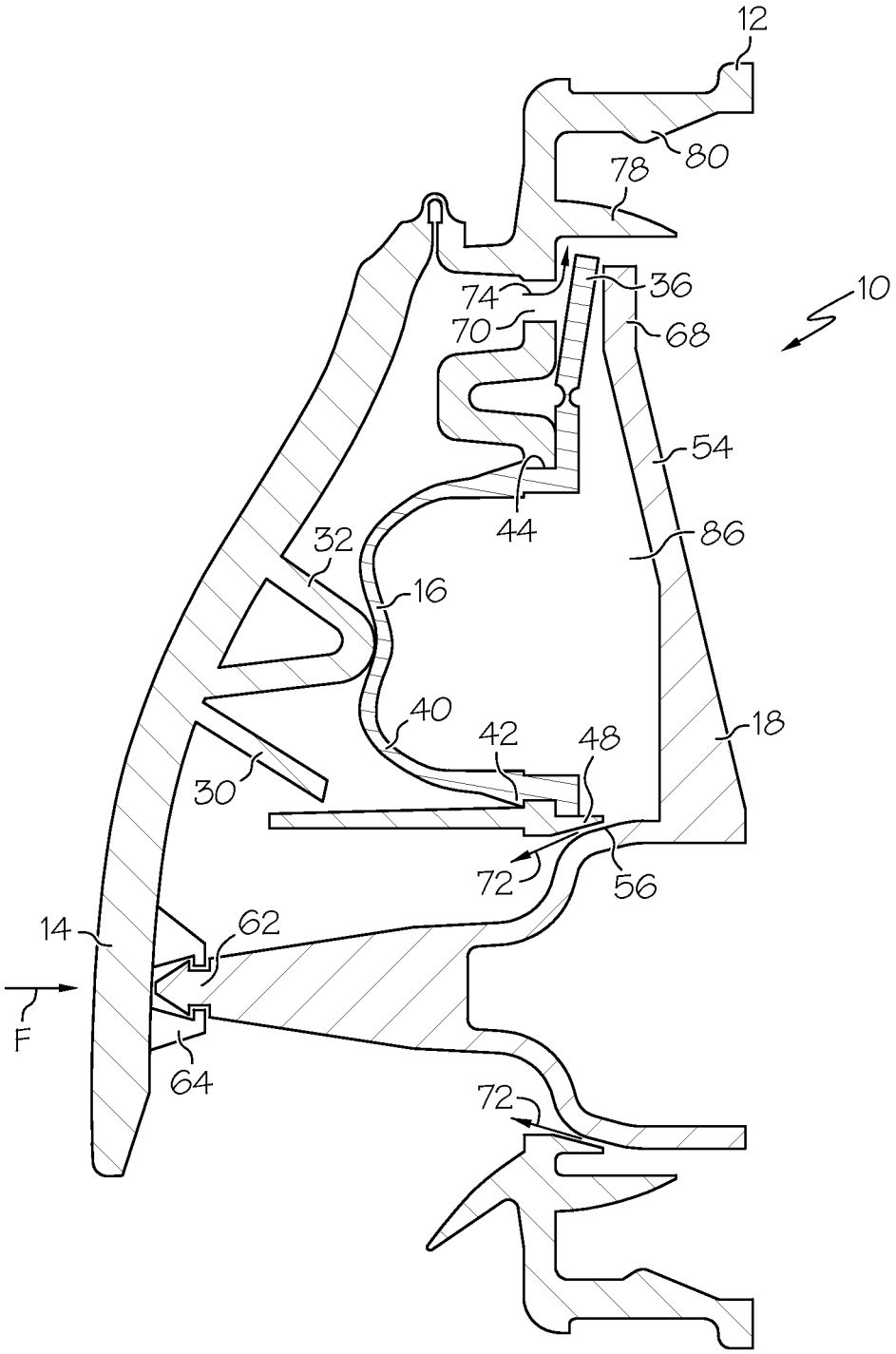
FIG. 4B shows a cross-sectional view of the valve assembly of FIG. 4A in a fluid flow configuration.

The body portion 34 further comprises a dome portion 40 and a retaining catch 42. The dome portion 40 is elastically deformable and acts as a spring when pressed on by actuator 32, as is shown in greater detail in FIGS. 4A and 4B. With particular regard to FIG. 2B, in some embodiments, the retaining catch 42 comprises a barb-like projection or region of increased material thickness, which is measured in cross-section. Adjacent to the retaining catch 42 is recess 44. As shown in FIGS. 4A and 4B, the resilient member 16 is retained in housing 12 via retaining catch 42; a portion of the housing 12 snaps into the recess 44 to hold the resilient member 16 in place.

Finally, as shown in FIG. 2B, the resilient member 16 comprises reinforced region 46 having increased material thickness. The reinforced region 46 provides an area of increased strength for the actuator 32 (FIG. 1A) to contact. And, as shown in FIGS. 2A and 2C, the resilient member 16 comprises a cutout 47. The cutout 47 fits around fluid dispensing port 48, as shown in FIGS. 1B, 4A, and 4B.

Figure 3A:
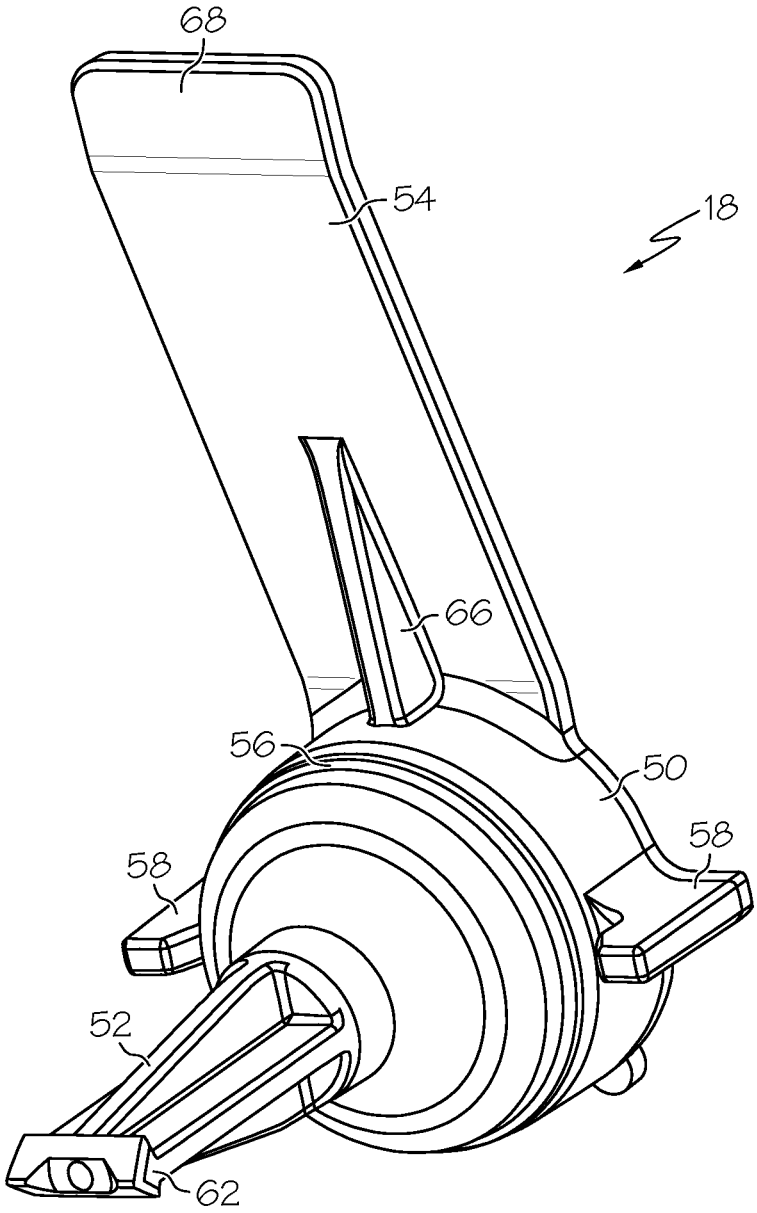
FIG. 3A shows a perspective view of an embodiment of the seal 18.
Figure 3B:
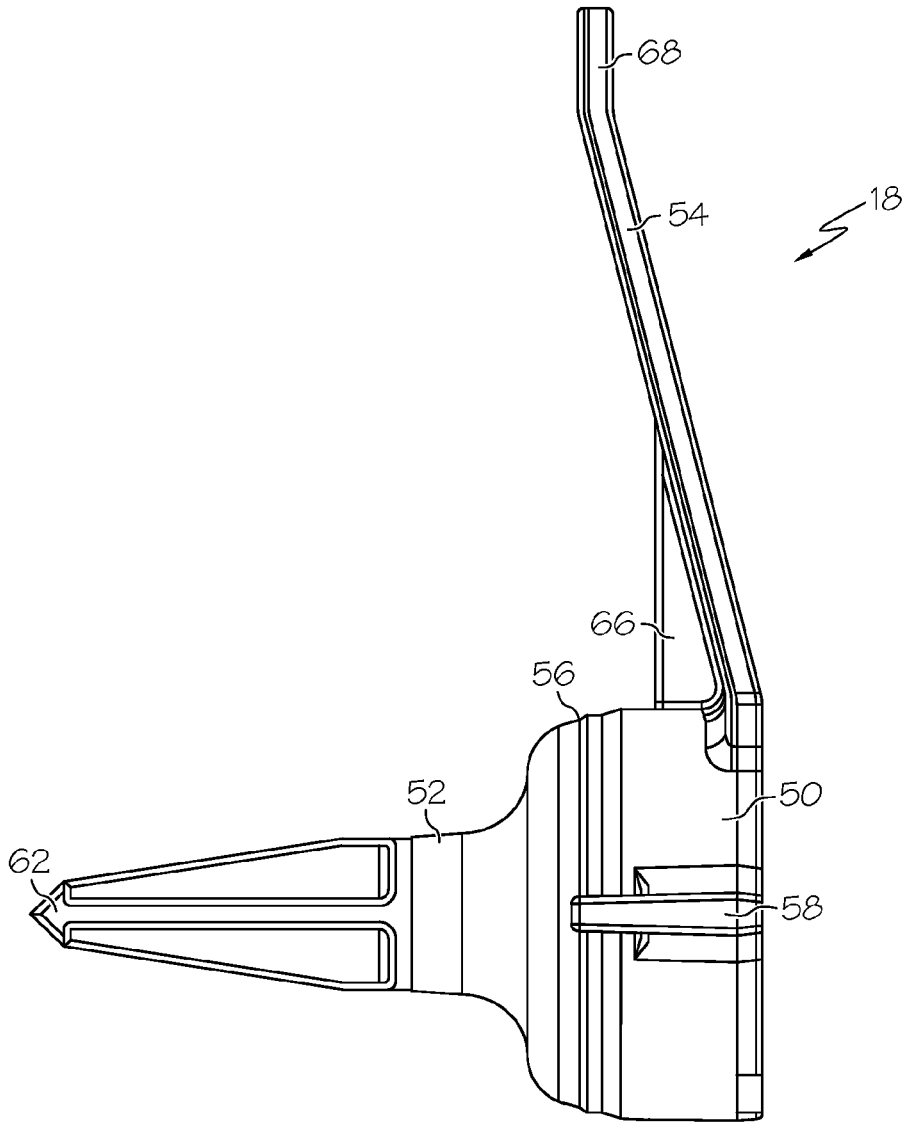
FIG. 3B shows a side view of the seal 18 of FIG. 3A.
Figure 3C:
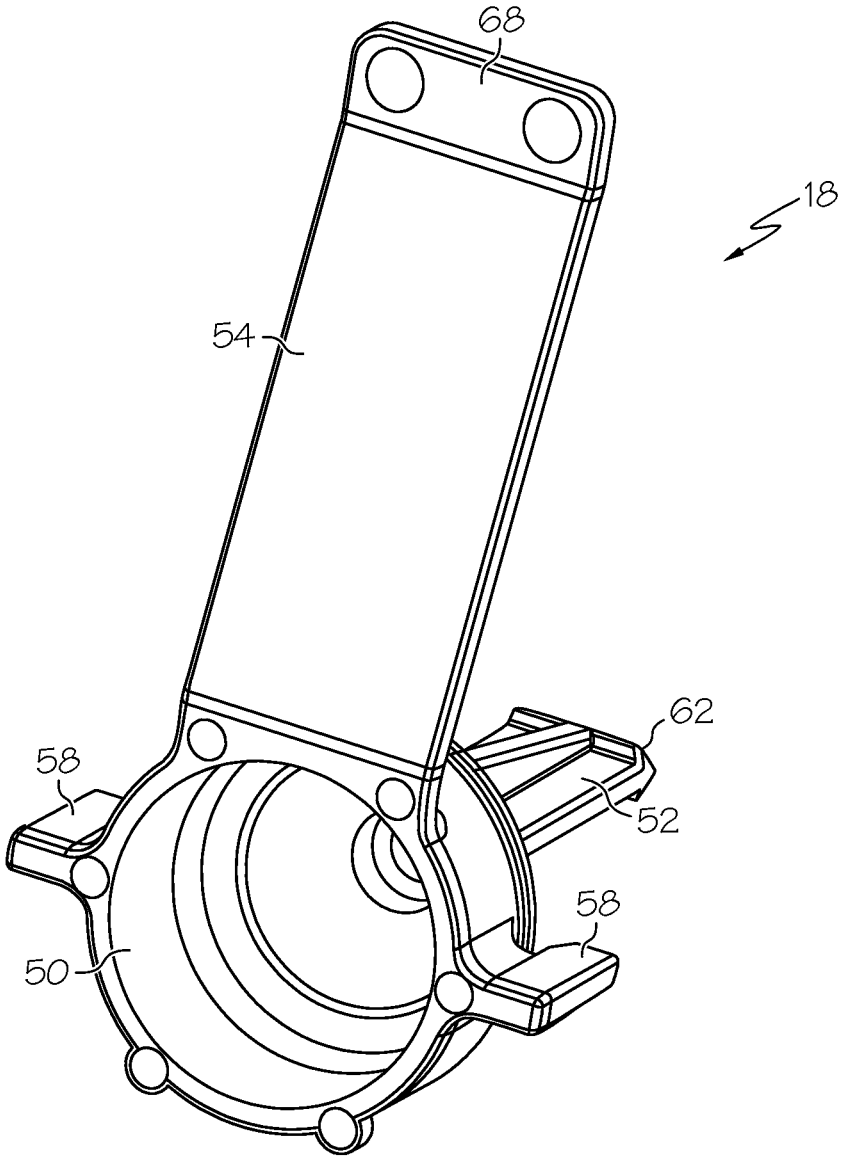
FIG. 3C shows a back perspective view of the seal 18 of FIG. 3A.

Turning now to FIGS. 3A-3C, an embodiment of the seal 18 is shown therein. The seal 18 comprises a base portion 50, a stem 52 extending from the base portion 50, and a sealing arm 54 extending from the base portion 50. In some embodiments, the base portion 50 comprises a sealing surface 56 that mates with fluid dispensing port 48 to create a fluid-tight seal between the housing 12 and the seal 18, as is shown in greater detail in FIG. 4A. Additionally, in some embodiments, the base portion 50 comprises at least one guide 58; in some embodiments, for example as shown in FIGS. 3A and 3C, the seal comprises two guides 58 that are located on opposite sides of the base portion 50. Returning to FIG. 1B, guides 58 are slidably disposed in channels 60 on housing 12. In this way, as the seal 18 is moved from a sealed configuration (FIG. 4A) to a fluid flow configuration (FIG. 4B) and vice-versa, the seal 18 tracks along channels 60 (FIG. 1B), ensuring proper alignment of the sealing surface 56 with the fluid dispensing port 48.

In some embodiments, the stem 52 comprises a latch 62. The latch 62 engages a keeper 64 on lever 14 (FIG. 1A). Keeper 64 retains latch 62 via a snap-fit connection, allowing for easy assembly of the housing 12 and seal 18. Further, the lever 14 and seal 18 are linked via keeper 64 and latch 62 (FIG. 1A) such that as the lever 14 is pushed, the seal 18 moves along channels 60 (FIG. 1B), permitting fluid to flow out of the valve assembly 10. In particular, in some embodiments, as the lever 14 pushes on the stem 52, moving the seal 18 along channels 60, the channels 60 restrain the seal 18 from becoming misaligned. Additionally, in some embodiments, the stem 52 elastically deforms as the seal 18 moves along the channels 60. In this regard, it will be appreciated that the keeper 64 sweeps an arc about hinge 28. Consequently, the latch 62 of stem 52 moves along the arc of the keeper 64. Nonetheless, the guides 58 (FIG. 1A) move along channels 60, thereby assuring that the base portion 50 of the seal 18 moves with respect to the housing 12 in a linear, non-arching fashion. This, in turn, promotes a higher rate of flow out of fluid dispensing port 48 (FIG. 4B). In some embodiments, because the stem 52 is elastically deformable the latch 62 sweeps an arc with keeper 64 and the base portion 50 of the seal 18 moves linearly along channels 60.

With further regard to FIGS. 3A-3C, in some embodiments, the sealing arm 54 extends upwardly at a cant. In some embodiments, the seal 18 comprises a gusset 66 extending between the sealing arm 54 and the base portion 50. The gusset 66 provides additional strength to the sealing arm 54. Additionally, the sealing arm 54 has an end portion 68. In some embodiments, the end portion 68 is angled relative to the sealing arm 54. In this way, the end portion 68 contacts the sealing tab 36 of the resilient member 16, for example as shown in FIG. 4A. In some embodiments, when the seal 18 is in the sealed configuration, for example as shown in FIG. 4A, the end portion 68 exerts a force on the sealing tab 36 to maintain the sealing tab 36 in the sealed configuration. In some embodiments, the sealing arm 54 is elastically deformable and acts as a spring, applying pressure to the sealing tab 36 when the valve assembly 10 is in the sealed configuration.

It will be appreciated that, in some embodiments, the seal 18 and sealing tab 36 need to hermetically seal with the housing 12 in close temporal relationship. In particular, the seal 18 and sealing tab 36 should seal at nearly the same time. Therefore, in some embodiments, the sealing arm 54 is made from a flexible material to prevent leakage and provide tolerance for variation in timing between closure of the seal 18 and sealing tab 36.

In some embodiments, the seal 18 is made from High Density Polyethylene (HDPE), for example Dow® DMDA-8409 NT 7. In some embodiments, the seal is made from a material having a hardness of 59 Shore D. Any other suitable material may also be used.

In some embodiments, the housing 12 is formed from polypropylene, for example Flint Hills Resources® polypropylene AP5520-HA. In some embodiments, the housing is formed from a material having a hardness of 100 Rockwell R. Other suitable materials with the same hardness or different other hardnesses may also be used, as will be appreciated by the skilled artisan. Moreover, in some embodiments, the housing 12 is formed from a different material than the seal 18. In particular, in some embodiments, the seal 18 comprises a softer and/or more flexible material than the material of the housing 12. The softer material of the seal 18 results in the seal 18 elastically deforming to the contour of the housing 12 at contacting locations. For example, the sealing surface 56 of the seal 18 deforms to provide a hermetic seal against the adjacent surface of the fluid dispensing port 48.

Turning to FIG. 4A, a cross-section of the valve assembly 10 is shown therein with the valve assembly 10 in the sealed configuration. For the purposes of illustration, however, the keeper 64 on hinge 14 is shown in cutaway. As shown in FIG. 4A, in some embodiments, the housing 12 defines a hole 86, which may also be referred to herein as a through hole. In some embodiments, a portion of the resilient member 16 extends through the through hole 86. In this way, the resilient member 16 can be formed from a single piece of material and function as a spring to interact with the lever 14 while also having sealing tab 36 disposed on the inside of the housing 12. In the sealed configuration, the sealing surface 56 of the seal 18 mates with the adjacent surface of the fluid dispensing port 48 to prevent fluid from exiting valve assembly 10. Furthermore, the sealing tab 36 covers vent opening 70.

In some embodiments, the resilient member 16 is partially deformed when the valve assembly 10 is in the sealed configuration. The resilient member 16 thereby pushes outwardly on the lever 14 via actuator 32. In turn, the keeper 64 pulls on the seal 18 to maintain a fluid tight seal between the fluid dispensing port 48 and the adjacent sealing surface 56. Additionally, in some embodiments, the sealing arm 54 applies pressure to the sealing tab 36.

Turning to FIG. 4B, when a force, F, is applied to the lever 14, for example with the operator's thumb, the lever 14 pushes inwardly on the seal 18. This, in turn, moves the seal 18 inwardly, guided by guides 58 and channels 60 (FIG. 1B). Fluid is thereby allowed to flow out of fluid dispensing port 48, as illustrated by arrows 72. Meanwhile, to equalize the pressure in the container, as fluid flows out of the container, air is allowed to flow into the container via the vent opening 70. The sealing tab 36 is allowed to move away from previously obstructed vent opening 70 as the sealing arm 54 moves inwardly toward the container. Air moving into the container is illustrated by arrow 74.

In some embodiments, the sealing tab 36 does not open immediately after the lever 14 is pushed inwardly. Instead, due to the fluid pressure on the backside of the sealing tab 36, it is initially forced closed. This, in turn, prevents a rush of liquid out through the fluid dispensing port 48. Once the pressure differential between the outside atmosphere and the inside of the container is sufficient, however, the sealing tab 36 opens, and air is allowed to flow into the container.

When the operator wants to stop fluid from flowing out of the container, the operator merely needs to stop applying force, F, to the lever 14. After force, F, is no longer applied, the resilient member 16 pushes on actuator 32 and the seal 18 is pulled outwardly via keeper 64 and latch 62. The valve assembly then reverts to the sealed configuration, as shown in FIG. 4A, when the lever 14 is released.

With the foregoing in mind, and returning now to FIG. 1A, in some embodiments, the housing 12 further comprises a shroud 76 surrounding the fluid dispensing port 48. The shroud 76 provides a flow path for fluid exiting the fluid dispensing port 48 and helps to keep contaminants away from fluid dispensing port 48. With reference to FIG. 1B, in some embodiments, the housing 12 further comprises a cork seal 78 and retaining ring 80. The cork seal 78 and retaining ring 80 permit the valve assembly 10 to be attached to a container having the appropriate interface, for example a cylindrical collar that snaps into place and is retained via cork seal 78 and retaining ring 80, as will be appreciated by one of skill in the art. The valve assembly 10 can also be attached to a container via other suitable methods, for example threads, an interference fit, ultrasonic welding, or adhesive. Other suitable options will be appreciated by the skilled artisan.

Figure 5:
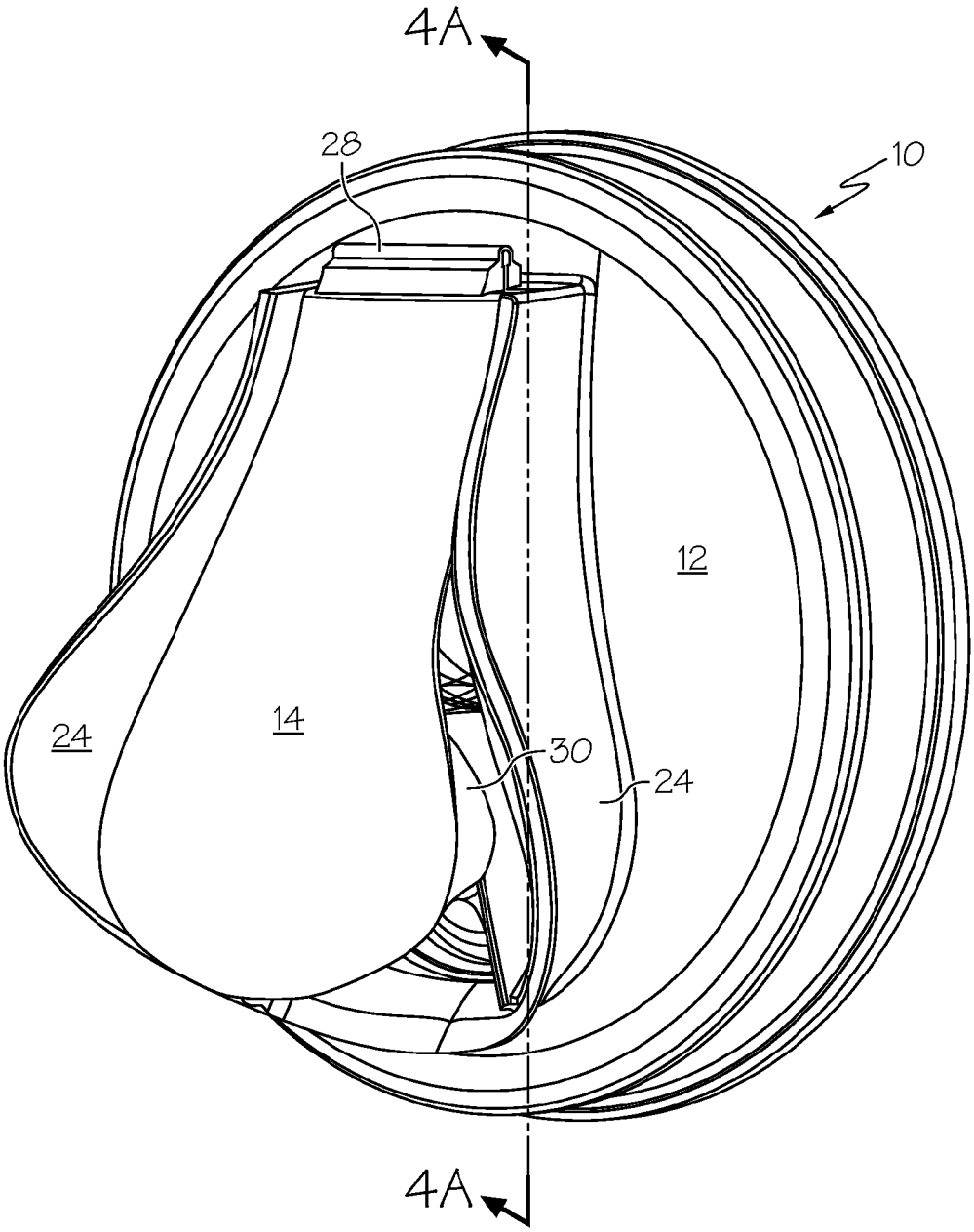
FIG. 5 shows a perspective view of the valve assembly 10 of FIG. 4A.

Turning to FIG. 5, the valve assembly 10 is shown therein in an "as-used" and sealed configuration. The lever 14 has been folded about hinge 28 from the "as-molded" configuration of FIG. 1A. Further, as shown in the cross-sectional view of FIG. 4A, the latch 62 has been snapped into place to attach to keeper 64. An operator can operate the valve assembly by placing his/her thumb on lever 14 and a forefinger and middle finger, respectively, on the outside of a flared grip member 24.

Figure 6A:
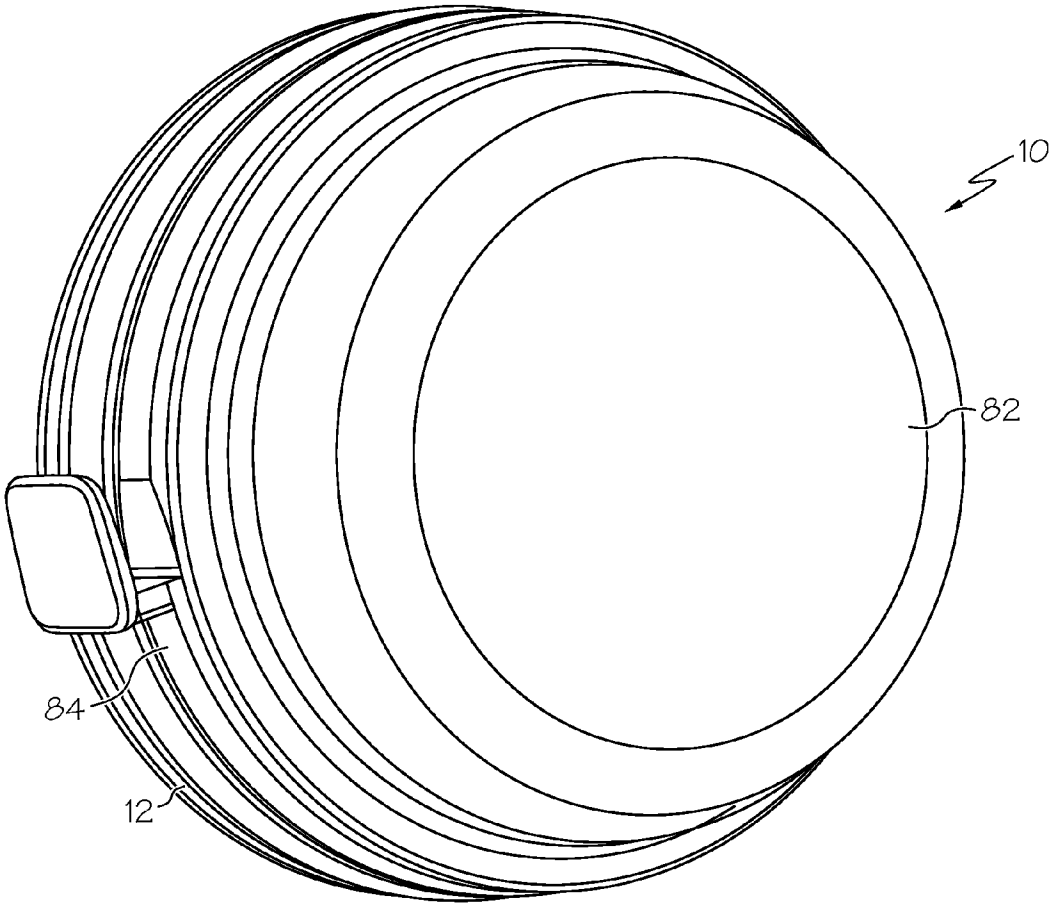
FIG. 6A shows a front perspective view of the valve assembly 10 with protective cap 82.

FIG. 6A shows the valve assembly 10 with a protective cap 82 covering the lever 14 (not visible) and the face 26 (not visible) of the housing 12. In some embodiments, the cap 82 has a removable tear strip 84 which is removed prior to use of the valve assembly 10. The tear strip 84 can show evidence of tampering.

Figure 6B:
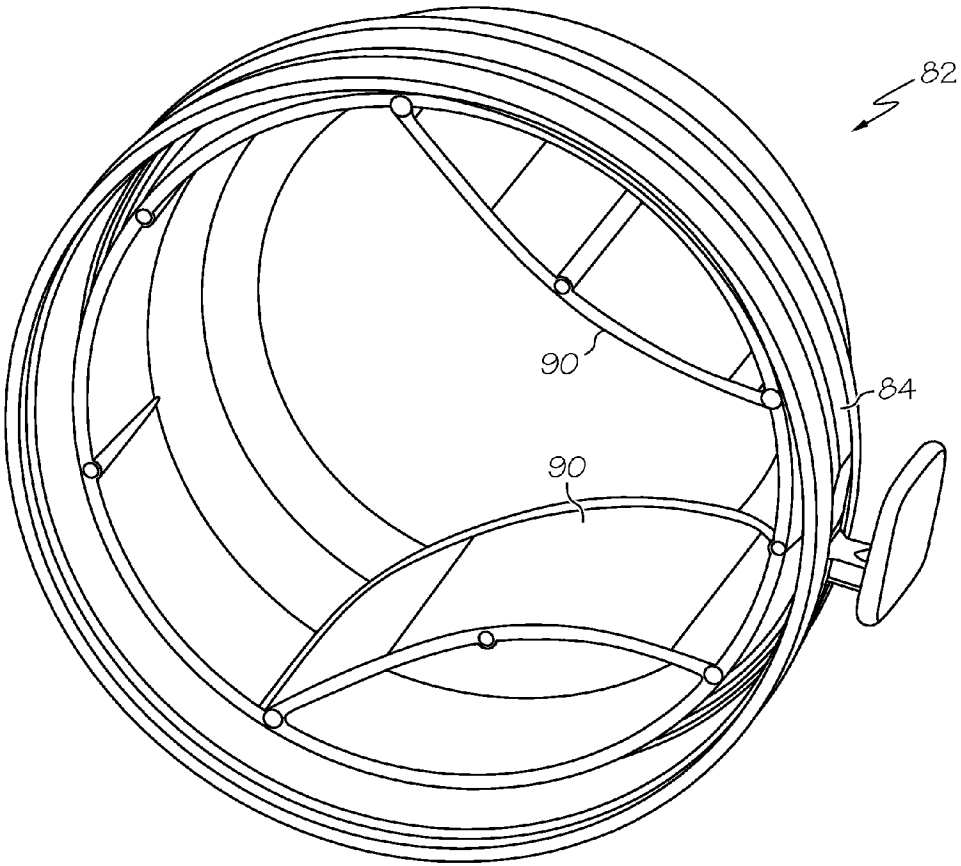
FIG. 6B shows a back perspective view of the protective cap 82 of FIG. 6A without valve assembly 10.

The cap 82 can be used during shipping of the valve assembly 10, during attachment of the valve assembly 10 to the container, or during storage, for example. The cap 82 helps to protect against contaminants or debris from interfering with the valve assembly 10 prior to use. Additionally, as shown in FIG. 6B, the cap 82 further comprises a plurality of ribs 90. The ribs 90 provide strength for the cap 82, for example, so valve assemblies 10 with protective caps 82 thereon can be stacked during shipping or storage.

In some embodiments, the valve assembly 10 consists of three components which are manufactured separately and assembled together. In particular, in some embodiments, the valve assembly 10 consists of a first component, comprising the housing 12 and the lever 14, a second component, comprising the resilient member 16, and a third component, comprising the seal 18. In some embodiments, these three components are formed in independent injection molding processes and are subsequently assembled into the valve assembly 10.

In some embodiments, the protective cap 82 is formed in another independent injection molding process. After assembly of the first, second, and third components into the valve assembly 10, the cap 82 is added thereto.

In addition to the foregoing, some embodiments are directed to a combination of the valve assembly 10 and container, for example a rigid container. In some embodiments, the valve assembly 10 can also be used with a flexible container or package.

U.S. application Ser. No. 12/839,860, filed on Jul. 20, 2010, and titled "Dispenser Assembly," is herein incorporated by reference.

The above disclosure is intended to be illustrative and not exhaustive. This description will suggest many variations and alternatives to one of ordinary skill in this field of art. All these alternatives and variations are intended to be included within the scope of the claims where the term "comprising" means "including, but not limited to." Those familiar with the art may recognize other equivalents to the specific embodiments described herein which equivalents are also intended to be encompassed by the claims.

Further, the particular features presented in the dependent claims can be combined with each other in other manners within the scope of the invention such that the invention should be recognized as also specifically directed to other embodiments having any other possible combination of the features of the dependent claims. For instance, for purposes of claim publication, any dependent claim which follows should be taken as alternatively written in a multiple dependent form from all prior claims which possess all antecedents referenced in such dependent claim if such multiple dependent format is an accepted format within the jurisdiction (e.g. each claim depending directly from claim 1 should be alternatively taken as depending from all previous claims). In jurisdictions where multiple dependent claim formats are restricted, the following dependent claims should each be also taken as alternatively written in each singly dependent claim format which creates a dependency from a prior antecedent-possessing claim other than the specific claim listed in such dependent claim below.

This completes the description of the preferred and alternate embodiments of the invention. Those skilled in the art may recognize other equivalents to the specific embodiment described herein which equivalents are intended to be encompassed by the claims attached hereto.

What is claimed is:

1. A fluid dispensing valve assembly comprising:

a housing, the housing defining a fluid dispensing port, a vent opening, and two channels that are arranged in a facing, opposed relationship, one on either side of the fluid dispensing port;

a lever extending from the housing over at least a portion of the fluid dispensing port;

an elastically deformable resilient member; and a seal comprising a guide, a base portion, a stem extending from the base portion, and a sealing arm extending from the base portion, at least a portion of the seal extending through the fluid dispensing port;

at least a portion of the elastically deformable resilient member and at least a portion of the stem contacting the lever;

wherein the guide is slidably disposed within one of the channels.

2. The assembly of claim 1, wherein the lever is hingedly attached to the housing.

3. The assembly of claim 1 having an open configuration and a sealed configuration, the resilient member further comprising a sealing tab, at least a portion of the sealing tab configured to cover the vent opening when the assembly is in the sealed configuration.

4. The assembly of claim 1, wherein the resilient member comprises a dome-shaped portion and a retaining catch.

5. The assembly of claim 1, wherein the housing defines a hole through which at least a portion of the resilient member extends.

6. The assembly of claim 1, wherein the seal comprises two guides, each guide slidably disposed within one of the two channels.

7. The assembly of claim 6, wherein the portion of the stem that contacts the lever is configured to move in an arc and the guides are configured to move linearly.

8. The assembly of claim 1, wherein the housing further comprises a pair of flared grip members.

9. The assembly of claim 1, wherein the lever is connected to the seal.

10. A fluid dispensing valve assembly having a sealed configuration and a fluid flow configuration, the valve assembly comprising:

a housing, the housing defining a fluid dispensing port and a vent opening;

a lever extending from the housing over at least a portion of the fluid dispensing port;

an elastically deformable resilient member comprising a sealing tab and a dome portion, the sealing tab sealing the vent opening when the valve assembly is in the sealed configuration; and a seal disposed within the fluid dispensing port and at least a portion of the seal contacting the sealing tab when the valve assembly is in the sealed configuration, wherein at least a portion of the dome portion contacts the lever.

11. The valve assembly of claim 10, wherein the seal comprises a base portion, a stem extending from the base portion, and a sealing arm extending from the base portion.

12. The valve assembly of claim 11, wherein at least a portion of the sealing arm contacts the sealing tab when the valve assembly is in the sealed configuration.

13. The valve assembly of claim 10, wherein the lever is connected to the seal.

14. The valve assembly of claim 10, wherein the housing comprises at least one channel and the seal comprises at least one guide, the guide slidably disposed within the channel.

15. The valve assembly of claim 10, wherein the resilient member comprises a retaining catch.

16. The valve assembly of claim 10, wherein the housing comprises a cork seal and a retaining ring opposed to the cork seal.

17. The valve assembly of claim 10, wherein the lever comprises an actuator, the actuator engaging the dome portion of the resilient member.

* * * * *